United States Patent [19]

Isler

[11] Patent Number: 4,538,940

[45] Date of Patent: Sep. 3, 1985

[54] ARRANGEMENT FOR FORCE TRANSFER BETWEEN LONGITUDINALLY STRESSED MEMBERS

[75] Inventor: Erwin Isler, Rapperswil, Switzerland

[73] Assignee: H. Weidmann AG., Rapperswil, Switzerland

[21] Appl. No.: 493,547

[22] Filed: May 11, 1983

[30] Foreign Application Priority Data

May 14, 1982 [CH] Switzerland ..... 3023/82

[51] Int. Cl.[3] ..... E21D 21/00

[52] U.S. Cl. ..... 405/259; 405/244; 405/258; 411/75; 411/77

[58] Field of Search ..... 405/259, 260, 261, 258, 405/244; 411/75-78; 403/334, 333

[56] References Cited

U.S. PATENT DOCUMENTS 2,850,937 9/1958 Ralston ..... 405/259 X
2,903,938 9/1959 Strand ..... 411/78
3,301,123 1/1967 Worley ..... 405/259 X
3,859,889 1/1975 Fischer ..... 411/75

*Primary Examiner*—Dennis L. Taylor
*Attorney, Agent, or Firm*—Sughrue, Mion, Zinn, Macpeak, and Seas

[57] ABSTRACT

For the progressive transfer of a tension or traction force from a fiber-reinforced plastic anchoring rod 10 to a threaded sleeve 20 surrounding one end of the rod, sawtooth shaped teeth are provided. The inclined flanks 6 of the teeth are increasingly longer as a function of the distance from the end 22 of the rod. The tooth length extension corresponds to the expansion of the rod under the local traction force which, because it becomes lower at each flank, decreases on a step-by-step basis. With this arrangement the rod can be stressed up to its breaking load without causing any damage to the threaded sleeve. This connection is suitable for any staying to fasten a cable to an anchoring element.

7 Claims, 4 Drawing Figures

ARRANGEMENT FOR FORCE TRANSFER BETWEEN LONGITUDINALLY STRESSED MEMBERS

BACKGROUND OF THE INVENTION

This invention concerns a tooth arrangement for the transfer of a force applied to a first element to a second element.

It is known to anchor tie rods in boreholes in order to fasten to surfaces which break out in cavity constructions and exposed embankments. Such tie rods consist mostly of individual anchoring rods which are fixed at the bottom or lower end of the borehole and tightened on an anchor plate at the outside or surface of the borehole with a threaded nut. One speaks of a slack rod if no or only a slight tension is produced in the rod, and of a pressurized rod if a considerable traction force is applied.

More recently, attempts have been made in connection with tie rods to replace the steel rods by cast plastic rods or tubes of fiberglass because, as with slack rods, they are not subject to creep or corrosion. However, the area of application has been limited to slack rods because the thread which was in any event not capable of transferring large forces weakened the anchoring rod. Experiments were carried out to place the thread on a sleeve surrounding the anchoring rod in a form suitable for the required traction forces of up to 15 tons, but difficulties arose with the transfer of the forces from the anchoring rod to the sleeve. The same problem arises, for example, in connection with the staying for high antennas in connecting the anchoring elements with the cables.

SUMMARY OF THE INVENTION

It is therefore an object of this invention to solve the problem of the force transfer from a first elongate element to a second elongate element when the two elements are placed on top of each other and are laterally pressed together by a force having a component vertical to the interfacing surfaces. This object is implemented by an arrangement wherein the interfacing surfaces are configured as mating sawtoothed elevations of equal height, with the widths of the teeth and attendantly the angles of inclination progressively increasing in a longitudinal direction.

DETAILED DESCRIPTION OF THE PREFERRED EMBODIMENT

Figure 1:
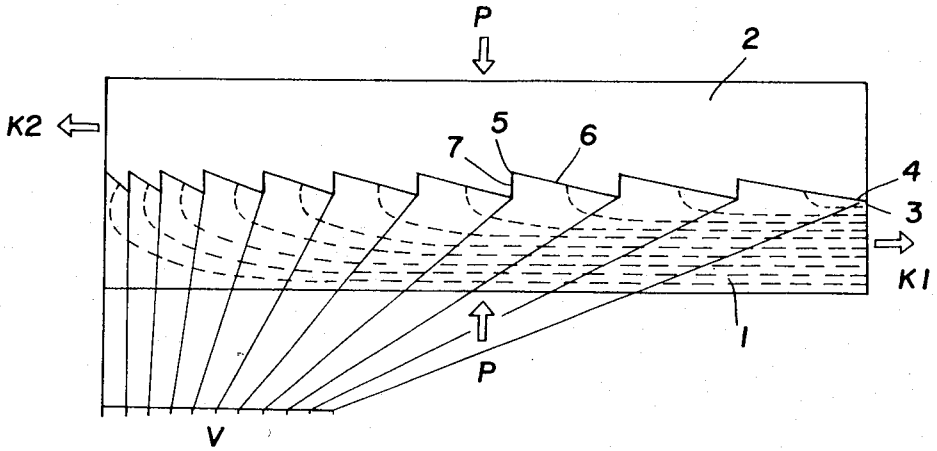
FIG. 1 is a schematic sectional view of two elongate elements coupled together or joined according to the principle of this invention.

In FIG. 1, two elongate elements 1 and 2 are placed on top of each other with their mating surfaces 3 and 4 pressed together vertically as indicated by arrows P. When a traction force K1 acts on the first element 1 towards the right in the drawing and/or a traction force K2 acts on the second element 2 towards the left in the drawing, this results in the same arrangement as when forces are transferred from an anchoring element to a sleeve as described above.

The idea on which the different length sawtooth flanks 6 are based with a constant ridge height 5 is to maintain constant the transmission of the force per unit of tooth length. For this reason, the expansion of the material was introduced with an increasing force from left to right and the lengths of the flanks 6 were extended or expanded, in comparison with the assumed original and unstressed length of a comparison rod V, in accordance with a tension force of one unit on the very left on a step-by-step basis up to ten units on the right. Owing to the constant areal or contact pressure on the flanks 6, the force K1 is uniformly reduced with each step and the second element 2, on the right in the drawing, on which no force is exerted pulls on the fictive fastening on the left with the total force K1 so that, inversely, the force K2 is actually the force K1 at this fastening. The development of the force is represented in the first element 1 by dotted lines.

Figure 2:
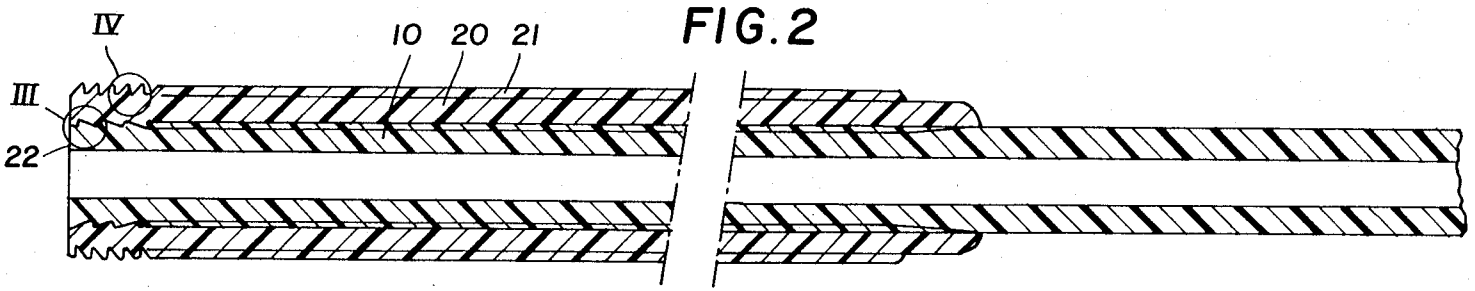
FIG. 2 is a sectional view of an anchoring element with a threaded sleeve using the toothing arrangement according to FIG. 1.
Figure 3:
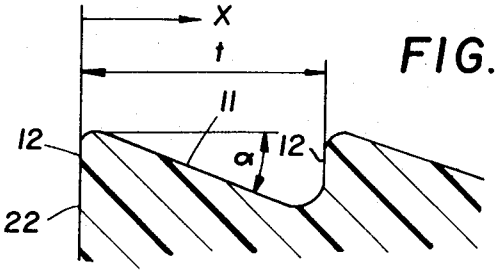
FIG. 3 is a sectional enlargement of point III in FIG. 2.
Figure 4:
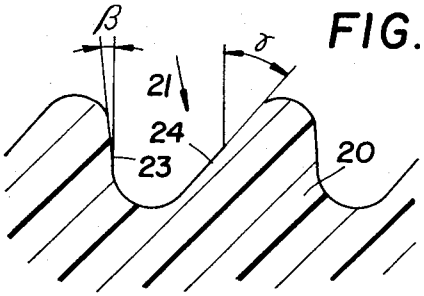
FIG. 4 is a sectional enlargement of point IV in FIG. 2.

The principle illustrated in FIG. 1 is applied to an anchoring rod 10 as shown in FIGS. 2–4. This anchoring rod, for example of fiber-reinforced plastic material, is provided with toothing at its end as is the first element 1 in FIG. 1. The long flanks 6 and the short flanks 7 are circumferential surfaces. The rod prepared in this manner is provided in an injection die mold with a sleeve 20, which has a tooth shape complementary to that of the anchoring rod and a section according to the second element 2 in FIG. 1. A thread 21 is formed on the outer circumference of the sleeve.

The toothed portion is clearly shown in FIG. 3. The angle of inclination $\alpha$ of the longer flank 11 (corresponding to flank 6 in FIG. 1) is a function of the distance X from the end 22 of the rod, and with 26 teeth, for example:

$$\alpha = e^{\left(\frac{525-X}{148}\right)}$$

Based on the angle $\alpha$, the axial length t of an inclined flank 11 between two adjacent vertical flanks 12 is:

$$t = \frac{1}{tg\alpha}\left[0.4 + \frac{0.8}{tg\frac{(90-\alpha)}{2}}\right].$$

The shape of the external thread 21, which is a buttress thread, is shown in FIG. 4. The angle of inclination of the steep tooth flanks 23 is $\beta = 5°$ and that of the flat tooth flanks 24 is $\gamma = 40°$, with a distance of 3.5 mm between the steep flanks and a tooth height of 1.84 mm. With this combination of toothing between the anchoring rod 10 and the threaded sleeve 20, and a buttress thread which is designed for large forces from the same direction, the traction force is transferred on a step-by-step basis from the tie rod to a nut on the sleeve 20 whereby the nut is subjected to stress over its entire length. Accordingly, the lines of force are transferred in discrete bundles over the long flanks 11 of the toothing to the threaded sleeve 20, and are practically uniformly transferred over the buttress thread 21 to a nut.

Although only the connection of an anchoring rod and a threaded sleeve is described above, other applications are also possible as, for example, in staying devices where a cable is to be fastened to a rod rammed or poured into the ground. Another application would be for the traction relief of cables of all kinds, including lighting conductors.

What is claimed is:

1. A structural arrangement for the transfer of a traction force (K1) applied to a first elongate element (1) and acting parallel to an interface surface (3) thereof, to a second elongate element (2) resting on the first element and having an interface surface (4) mating with that of the first element, said second element being held in place and being pushed against the first element with a lateral force (P) directed approximately vertically to the interface surfaces, the improvement comprising: a plurality of parallel, sawtooth shaped elevations of equal height (5, 6, 7) on both interface surfaces engaged with each other in a shape-locked manner, defining corresponding inclined flanks (6) of increasing length in the direction of application of the traction force on the first element and being essentially in full flank surface contact with each other; whereby, each tooth transmits nearly the same amount of force from said first element to said second element.

2. Arrangement according to claim 1, wherein the increase in the length of the flanks is equal to the axial expansion of the first element under the traction force, which decreases with the progressive transfer of said force to the second element.

3. A structural arrangement for the transfer of a traction force (K1) applied to a first elongate element (1) and acting parallel to an interface surface (3) thereof, to a second elongate element (2) held in place and resting on the first element and having an interface surface (4) mating with that of the first element, said second element being pushed against the first element with a lateral force (P) directed approximately vertically to the interface surfaces, the improvement comprising: a plurality of parallel, sawtooth shaped elevations of equal height (5, 6, 7) on both interface surfaces engaged with each other in a shape-locked manner defining corresponding inclined flanks (6) increasingly shorter in the direction of application of an increasing traction force ($\overline{KI}$) on the first element and being essentially in full flank surface contact with each other; such that each tooth transmits nearly the same amount of force from said first element to said second element.

4. Arrangement according to claim 3, wherein the decrease in the length of the flanks is equal to the axial contraction of the first element under the traction force, which is progressively transferred to the second element.

5. Arrangement according to claim 1, wherein the first element comprises an anchoring rod (10) and the second element comprises a sleeve (20) surrounding a portion of the rod, and wherein ridges (5) of the teeth elevations are disposed on a cylindrical surface.

6. Arrangement according to claim 5, wherein short flanks (7) of the teeth elevations lie on parallel planes vertically spaced on and perpendicular to the axis of the elements.

7. Arrangement according to claim 6, wherein the angle of inclination of the inclined flanks becomes increasingly less sharp proceeding from the sleeve end of the anchoring rod.

* * * * *